US008305211B1

(12) United States Patent
Morris et al.

(10) Patent No.: US 8,305,211 B1
(45) Date of Patent: Nov. 6, 2012

(54) METHOD AND APPARATUS FOR SURVEILLANCE SYSTEM PEERING

(75) Inventors: Stephen Jeffrey Morris, Harvard, MA (US); Steven Arnold Bolton, Harvard, MA (US)

(73) Assignee: VidSys, Inc., Vienna, VA (US)

( * ) Notice: Subject to any disclaimer, the term of this patent is extended or adjusted under 35 U.S.C. 154(b) by 531 days.

(21) Appl. No.: 12/571,953

(22) Filed: Oct. 1, 2009

Related U.S. Application Data

(60) Provisional application No. 61/102,552, filed on Oct. 3, 2008.

(51) Int. Cl.
*G08B 13/00* (2006.01)

(52) U.S. Cl. ..... 340/541; 340/568.6; 340/5.51

(58) Field of Classification Search ..... 340/541, 340/540, 545.1, 545.4, 545.6–545.9, 550, 340/565–567, 568.6, 5.1–5.2, 5.21–5.28, 340/5.3, 5.51, 5.8
See application file for complete search history.

(56) References Cited

U.S. PATENT DOCUMENTS

| | | | | |
|---|---|---|---|---|
| 7,457,288 | B2 * | 11/2008 | Park et al. | 370/390 |
| 2006/0165068 | A1 * | 7/2006 | Dalton et al. | 370/352 |
| 2008/0278579 | A1 * | 11/2008 | Donovan et al. | 348/143 |
| 2010/0070097 | A1 * | 3/2010 | Morgenstern et al. | 700/284 |
| 2010/0281171 | A1 * | 11/2010 | Khasnabish | 709/227 |
| 2012/0056742 | A1 * | 3/2012 | Tedesco et al. | 340/540 |

* cited by examiner

*Primary Examiner* — Daniel Previl
(74) *Attorney, Agent, or Firm* — Chapin IP Law, LLC

(57) ABSTRACT

A security installation positions a peering ability with a peer installation by establishing a peering agreement to define the conditions constituting a situation for which peering applies, and identifies the resources and assets which will be shared, as well as the duration of the peering, typically until the resolution of the exigent situation or circumstances that prompted the peering. Peering selectively couples security installations for monitoring a particular upon determining that a situation responsive to mediation has occurred within an area monitored by the security installation for monitoring an area. The security installation initiates a peering invitation to a peer installation, in which the peer installation is configured to share resources with the security installation for mitigating the cause of the situation. The resulting peered access provides communication between the peer installation and the security installation, the access being temporary and conditional on the exigency of the determined situation.

24 Claims, 8 Drawing Sheets

METHOD AND APPARATUS FOR SURVEILLANCE SYSTEM PEERING

RELATED APPLICATIONS

This Patent Application claims the benefit under 35 U.S.C. §119(e) of the disclosure of U.S. Provisional Patent Application No. 61/102,552, filed Oct. 3, 2008, entitled "METHOD AND APPARATUS FOR VIDEO SYSTEM PEERING," incorporated herein by reference in entirety.

BACKGROUND

Security systems covering a physical area such as a warehouse, school or office park may range greatly in coverage, robustness, and the technology employed. Since security breaches may tend to arise infrequently, such issues are usually only visited when unforeseen anomalies occur, thus allowing security artifacts to blend in to the status quo. Modern conventional security systems typically employ an array of video monitors coupled with perimeter detection devices such as door/window detectors and motion sensors. More sophisticated systems employ selective entry controls requiring a pass card or number code for entry. Nonetheless, typical day-to-day operations often do not call for an affirmative response by the security system in place. One of the factors affecting security installation robustness is that adequacy of an installation may never be considered until an adverse situation develops.

Nonetheless, modern availability of security resources and assets, as well as heightened public awareness of physical security breaches, have placed a burden on businesses, governments, educational institutions and other property owners to maintain some level of security within an area that they oversee and/or maintain. Modern media attention and the litigious nature of modern society have increased the liability of failure to adequately maintain at least a minimum level of security in the event that personal injury or property damage results from an intrusion, breach, or other incident such as fire or hazmat spill. Accordingly, it is commonplace for a security installation to be provided for any common area in which people congregate, such as businesses, schools, transportation systems, government facilities and universities, as well as common access and single owner residential facilities.

A particular area such as a school campus, institution, building, or collection thereof, may be therefore be protected by a security installation—an arrangement of surveillance and restriction devices electronically connected and may be operated by dedicated security personnel. Such a security installation, including features such as video monitors, remote door locks, mechanical gates, motion and other sensors and RFID tags for identifying and tracking people and objects, may be selected for a particular area, facility, building or campus for providing security and intrusion detection for those within.

SUMMARY

Recent decades have been marked by increasing availability of electronic security and surveillance equipment, particularly for audio and video recording and transmission capability. Advances in video technology, remote sensors and microprocessor based controls have increased availability of video monitoring systems, home perimeter protection, and object identification and tracking mechanisms such as RFID (Radio Frequency Identification) and bar code symbols. Video recording systems, once reserved for "high risk" installations such as banks, are now commonplace in retail, public transportation, and commercial locations.

Accordingly, it is commonplace for a security installation to provide surveillance and security over an area or facility. Security installations for covering large facilities or areas such as warehouses, educational institutions, corporate building clusters, public schools, and others with large "campus like" areas present many options and possible approaches for an appropriate arrangement of security resources and assets. Often, such a security installation includes a variety of sensory resources (devices), such as video and audio receptors (cameras), motion and perimeter (i.e. door and window) sensors, and heat/smoke alarms, and assets for response, such as remote locks, lights, mechanical gates, and alarms to external entities (i.e. police, fire). A centralized location or station, possibly including a server for automated control, is configured for human staffing for observing video monitors and manually intervening when appropriate. The server may be configured to provide Physical Security Information Management (PSIM) capability, such as through PSIM products offered by VidSys Inc., of Marlborough, Mass., assignee of the present application.

A centralized PSIM server (server) integrates the various resources and assets in the security installation, including selective coupling with a remote command and control system for remote and/or supplemental sharing of control and data. Configurations herein are based, in part, on the observation that a dynamic ability to link the technological security resources (i.e. video, communications, control) of multiple organizations, such as between an affected entity or institution and a first responder, may not be achievable in response to an exigent scenario. For example, in the case of a fire at a school, it would be beneficial if the fire department were afforded immediate remote access to the security installation including the video and communication systems at the school, to obtain advance information of the severity and to possibly direct evacuation accordingly even before arriving on scene. Unfortunately, conventional security systems suffer from the shortcoming that a readily available link or connection between security systems of different entities may not be established in a timely manner when a situation warranting such a connection develops.

Such remote access provides invocation of another security installation or system as a peer, thus allowing sharing of control and information for managing a security response scenario. A peering arrangement and interface as disclosed herein substantially overcomes the above described shortcomings by allowing the peered system, such as operated by a police, fire, or other first responder, to access resources and control assets of the security installation experiencing the breach, situation, or anomaly for which a response has been requested. A security installation predisposes a peering ability with a peer installation by establishing a peering agreement to define the conditions constituting a situation for which peering applies, and identifies the resources and assets which will be shared, as well as the duration of the peering, typically until the resolution of the exigent situation or circumstances that prompted the peering.

Peering as defined herein is the ability for two or more 'systems' to share resources, such as video cameras, maps, diagrams, documents, other video and non-video resources, and to allow access and control of these resources to be available to the peer on either a full-time or as needed/allowed basis.

Security installation peering, therefore, provides a mechanism for the locally defined resources to be known and accessed by the peer, i.e. it contains a directory service of resources and access to the resources. Additionally, it may provide metadata about the resources that allows the peers to organize the resource directories for logical display on a remote system, i.e. the directory service may provide metadata that describes what the resources are, where they are, what they are capable of, etc. This would allow a remote peer to place the resources on a 'map;' it may also allow the remote system to retrieve a floor plan of a peer to place those resources on for display; in the case of physical devices, it may tell what type of device a particular resource is, and what services that resource provides. In the case of a 'camera' it may tell what make/model camera it is, if the camera supports PTZ (Pan Tilt Zoom), what format of video it is capable of sending, where it's physically located via GIS coordinates, and logically 'where' it is located, i.e. what part of a building it's located in such as "Second Floor," or "Library."

The peered systems may be owned and operated by the same organization, in any suitable topology, for example, hub and spoke, hierarchal, mesh, ad-hoc, or hybrid snow flake, i.e., hierarchal organization of different hub and spokes. They may also be owned and/or operated by different organizations or the same organization but operated locally separate, maintaining independence of topology. Peering between different organizations is typically thought of as autonomous peering, i.e., each system is usually operated and managed independently, and devices are not defined in both systems. The peer institution typically only knows of the others resources via the peering relationship, and not because some operator has preconfigured the peer's resources into both systems.

Peering may be hierarchal, such that if a system peers with a system that has a higher level peer, for example a school peering unidirectional with a local police department, and that local police department maintains a peering relationship (uni or bi-directional) with a state or regional police department, and so on with the FBI, that the highest level peer may be able to access the resources of the 'local' school system depending on the peering relationships, levels of authorization etc.

In further detail, the peering method for selectively coupling security installations for area monitoring as disclosed herein includes determining that a situation responsive to mediation has occurred within an area monitored by a security installation, in which the security installation has resources for monitoring the area and assets responsive to the security installation for interrogating the area. In response to the situation, the security installation initiates a peering invitation to a peer installation, in which the peer installation is configured to share resources with the security installation for mitigating and/or monitoring the cause of the situation. Prior to permitting peer access, the security installation validates the identity of the peer installation to confirm authorization to connect to the security installation for peering, and permits access to resources (e.g. video cameras, door controls, lights, PA systems) within the security installation from the peer installation, such that the permitted access providing communication from the accessed resource to the peer installation and control from the peer installation to an asset within the security installation, the permitted access being temporary and conditional on the exigency of the determined situation.

Alternate configurations of the invention include a multiprogramming or multiprocessing computerized device such as a workstation, handheld or laptop computer or dedicated computing device or the like configured with software and/or circuitry (e.g., a processor as summarized above) to process any or all of the method operations disclosed herein as embodiments of the invention. Still other embodiments of the invention include software programs such as a Java Virtual Machine and/or an operating system that can operate alone or in conjunction with each other with a multiprocessing computerized device to perform the method embodiment steps and operations summarized above and disclosed in detail below. One such embodiment comprises a computer program product that has a computer-readable storage medium including computer program logic encoded thereon that, when performed in a multiprocessing computerized device having a coupling of a memory and a processor, programs the processor to perform the operations disclosed herein as embodiments of the invention to carry out data access requests. Such arrangements of the invention are typically provided as software, code and/or other data (e.g., data structures) arranged or encoded on a computer readable medium such as an optical medium (e.g., CD-ROM), floppy or hard disk or other medium such as firmware or microcode in one or more ROM, RAM or PROM chips, field programmable gate arrays (FPGAs) or as an Application Specific Integrated Circuit (ASIC). The software or firmware or other such configurations can be installed onto the computerized device (e.g., during operating system execution or during environment installation) to cause the computerized device to perform the techniques explained herein as embodiments of the invention.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

Figure 1:
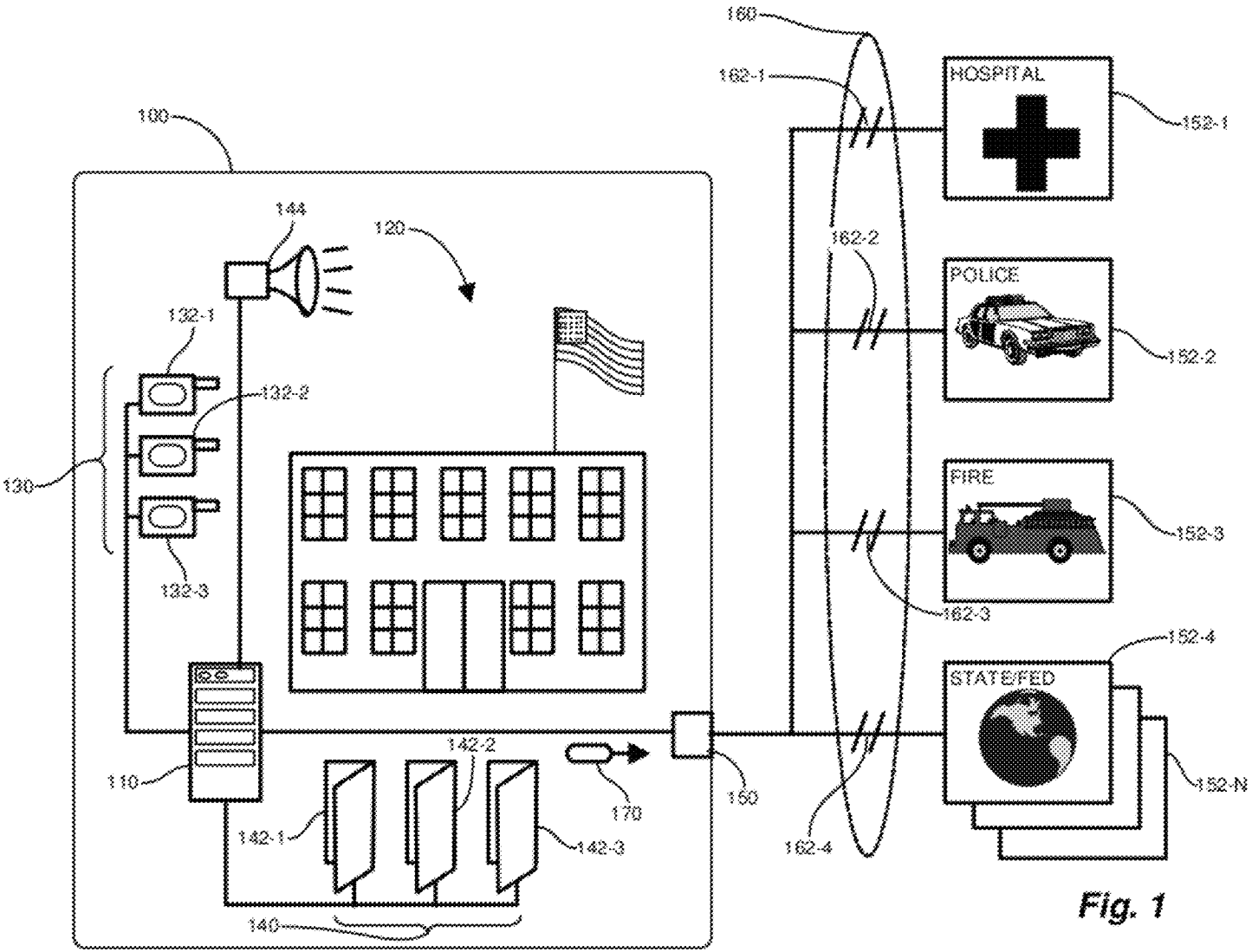
FIG. 1 is a context diagram of a monitored environment suitable for use with the present configuration.

Disclosed below is a description and several scenarios depicting peering of a security installation (security system) covering a particular area with a peer installation to which the peering request is directed. In the case of a bi-directional peering, the sharing of resources is mutual and the distinction of a security installation and peering installation servers to merely distinguish the separate installations. In the case of a unidirectional system, the peer installation is the one sought for peering and is the installation extended the access into the security installation, although the reverse does not necessarily apply. Particular features discussed further below include the immediacy of the peering that is enabled by a preexisting peering agreement and identified peering interface, the conditions under which peering is initiated, particularly exigent circumstances, and the extend and duration of access—how much access and for how long. Peering differs from a continuous or intermittent connection because the peering is enabled in response to an exigent situation, and is therefore designed to be quickly enabled, and only for the duration of the exigent situation that calls for peer access. In the hypothetical scenarios that follow, these parameters will be defined in terms of example usage; other uses and extent of parameters may be apparent.

As an example use case, consider school system in a large metropolitan area has concerns about its security, and has installed a video monitoring system with 30 cameras. The cameras are located in the hallways, by the doors, and in common rooms, such as the cafeteria, and library. They may or may not have cameras in every classroom, and they may or may not have recording devices for the video (typically Network Video Recorders). Additionally, they have a floor plan of the school and on it they have indicated the location of the cameras. They have a building wide access control system that allows areas of the school to be locked down, that is there is control over individual door locks, and definitions about what an area is, for example locking down the "South Wing" would mean to lock doors 1, 8, and 27. There are no security personnel at the school; the only local monitoring of the local cameras is a couple 'TV' monitors in the vice-principal's office, doing an automatic 'tour' of the school's cameras. Typically, no one is watching the monitors.

In this use case, there is a potential problem detected, a possible gun shot is heard via a monitor (camera w/ audio) at the school, and the local police have been contacted. The local police have a unidirectional peering relationship with the school. Police officers are dispatched to the school, at the same time, the police HQ is bringing up the floor plan of the school and starting to examine the cameras in the school via the peering relationship to determine the potential cause and current status. On their cameras they either see things are pretty normal looking, kids walking around etc., or they see panic and chaos. Either way, they relay that information to the officers en route, and if appropriate send location information as to what areas of the school are in trouble and forward any interesting video feeds to the officers' cars.

In the case of an escalated situation, the local police may elect to call in the state police, and since the local police and the state police also have a peering relationship (possibly two way), the local police could allow the state police to use their peering capability into the school as well.

FIG. 1 is a context diagram of a monitored environment suitable for use with the present configuration. Referring to FIG. 1, a monitored environment 100 includes a security installation 110 securing an area 120 or facility. The secured area 120 may be an institutional building such as a school or hospital, business or educational complex, or industrial site such as a warehouse environment. The security installation 110 includes resources 130, such as video cameras 132-1 . . . 132-3 (132 generally), and assets 140, such as door locks 142-1 . . . 142-3 (142 generally). The security installation 110 has a peer interface 150 to potential peer installations 152-1 . . . 152-N (152 generally), coupled by a selective peer connection 160, including selectively activated peer links 162-1 . . . 162-4 (162 generally) to the individual peer installations 152. Depending on the nature and robustness of the peer installation 152, the peer links 162 may vary in robustness and capability. Upon determination of an exigent situation (situation), the peer connection 160 is invoked via the peer interface 150 to activate one or more of the peer links 162. The peer connection 160 allows the peer installation 152 to invoke resources such as the cameras 152, and operate assets such as doors 142 and voice communications 144, such as a public address (PA) system. Thus, the peering of the peer installation 152-3 of the fire department would allow fire personnel to observe video cameras 132 and make announcements for directing exiting crowds away from fire and smoke via voice communications 144 (e.g. PA).

Figure 2:
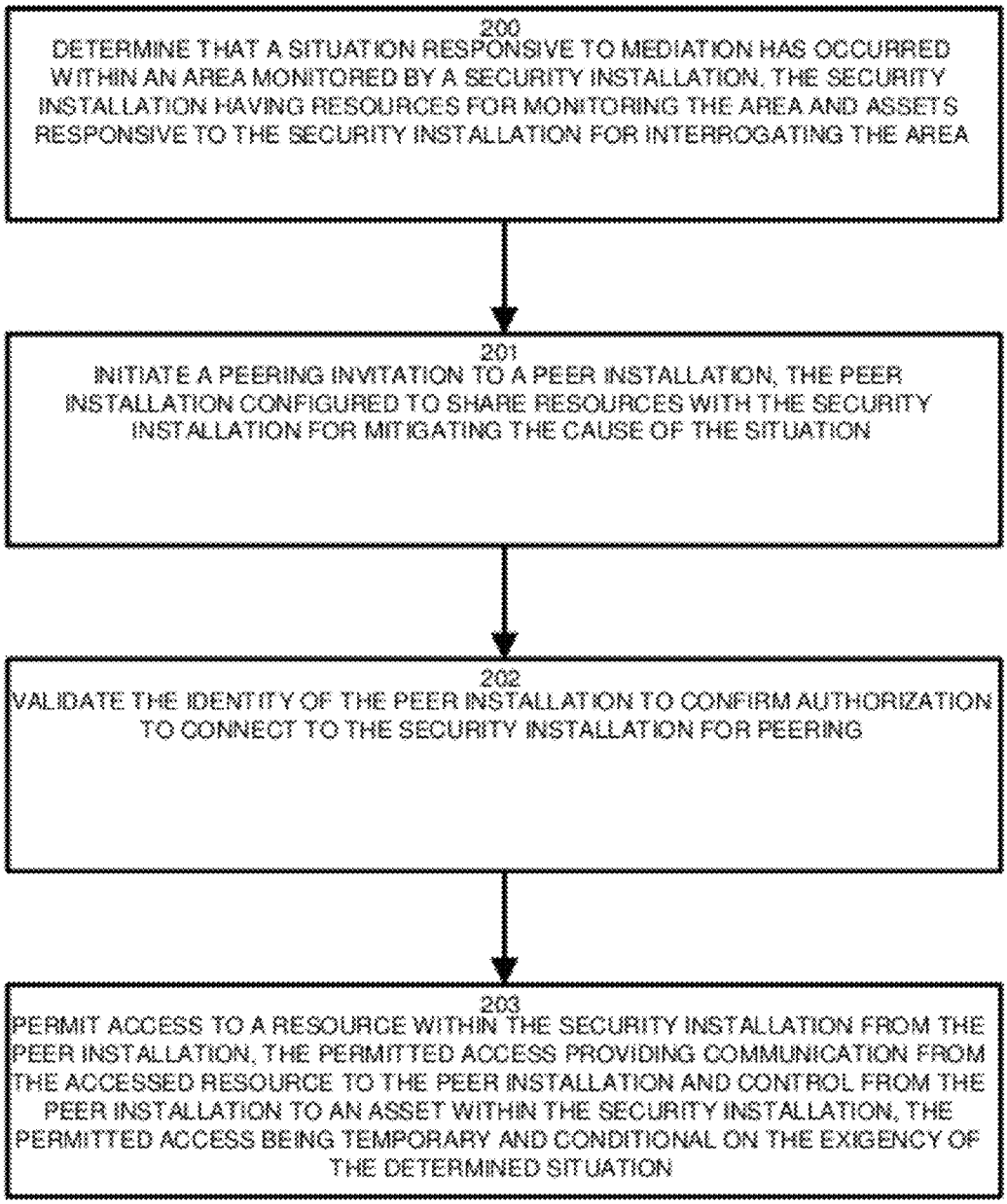
FIG. 2 is a flowchart of security system peering in the environment of FIG. 1.

FIG. 2 is a flowchart of security system peering in the environment of FIG. 1. Referring to FIGS. 1 and 2, the method of selectively coupling security installations for area monitoring as disclosed herein includes, at step 200, determining that a situation responsive to mediation has occurred within an area 100 monitored by a security installation 110 having resources 130 for monitoring the area, and assets 140 responsive to the security installation 110 for interrogating the area 100. The security installation 110 initiates a peering invitation 170 to a peer installation 152, in which the peer installation 152-N is configured to share resources 130 and assets 140 with the security installation 110 for mitigating the cause of the situation, as depicted at step 201. The peer installation 152 may, for example, be a security system of a local first responder such as police 152-2 or fire 152-3, or it may be of a less exigent nature, such as a security installation of a related company or corporate partner seeking peering for efficiency or logistic reasons rather than an emergency response. The security installation 110 validates the identity of the peer installation 152 to confirm authorization to connect to the security installation 110 for peering, as shown at step 202, to avoid unwarranted access and to identify any predetermined peering parameters such as access and duration, discussed further below. Following successful validation, or authentication, the security installation permits access to a resource 130 within the security installation 110 from the peer installation 152, such that the permitted access provides communication from the accessed resource 130 to the peer installation 152 and control from the peer installation 152 to an asset 140 within the security installation 110, as depicted at step 203. The permitted access is generally temporary and conditional on the exigency of the determined situation, however duration and/or extent of access may be varied to suit the situation at hand, also discussed further below.

Figure 3:
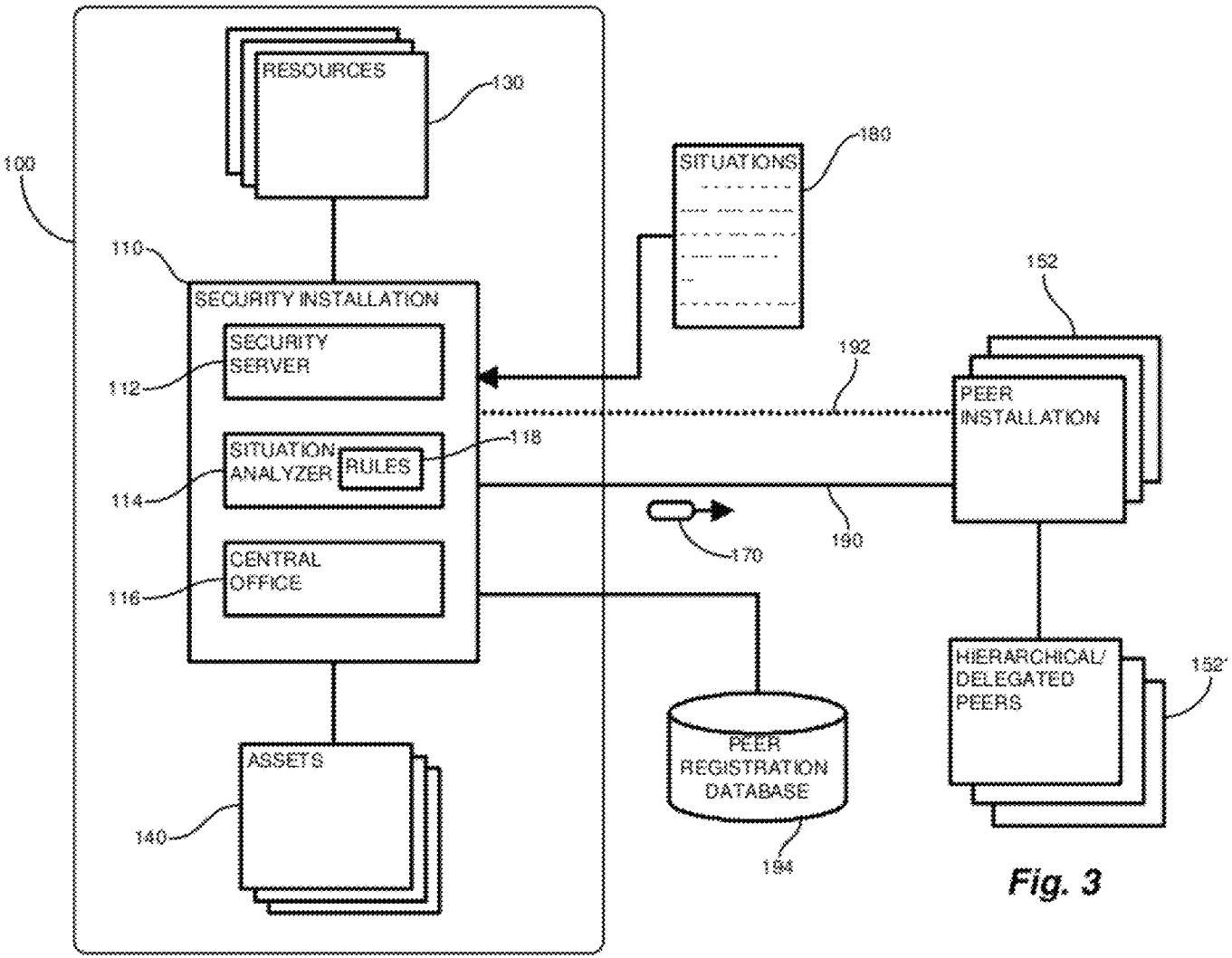
FIG. 3 is a block diagram of security monitoring system peering according to the flowchart of FIG. 2.
Figure 4:
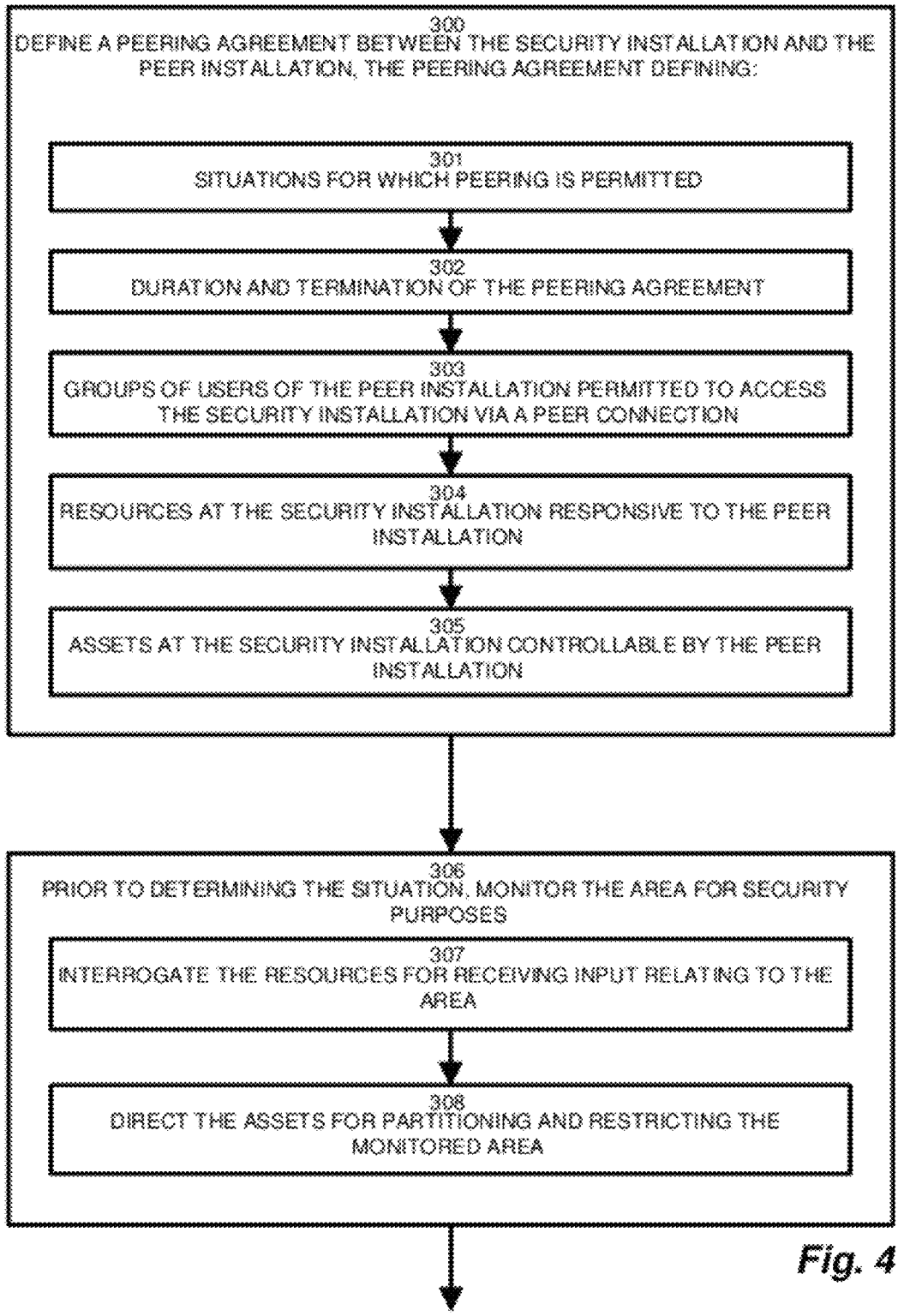
FIGS. 4-8 are a flowchart of security system monitoring, detection, and peering in the system depicted in FIG. 3.
Figure 5:
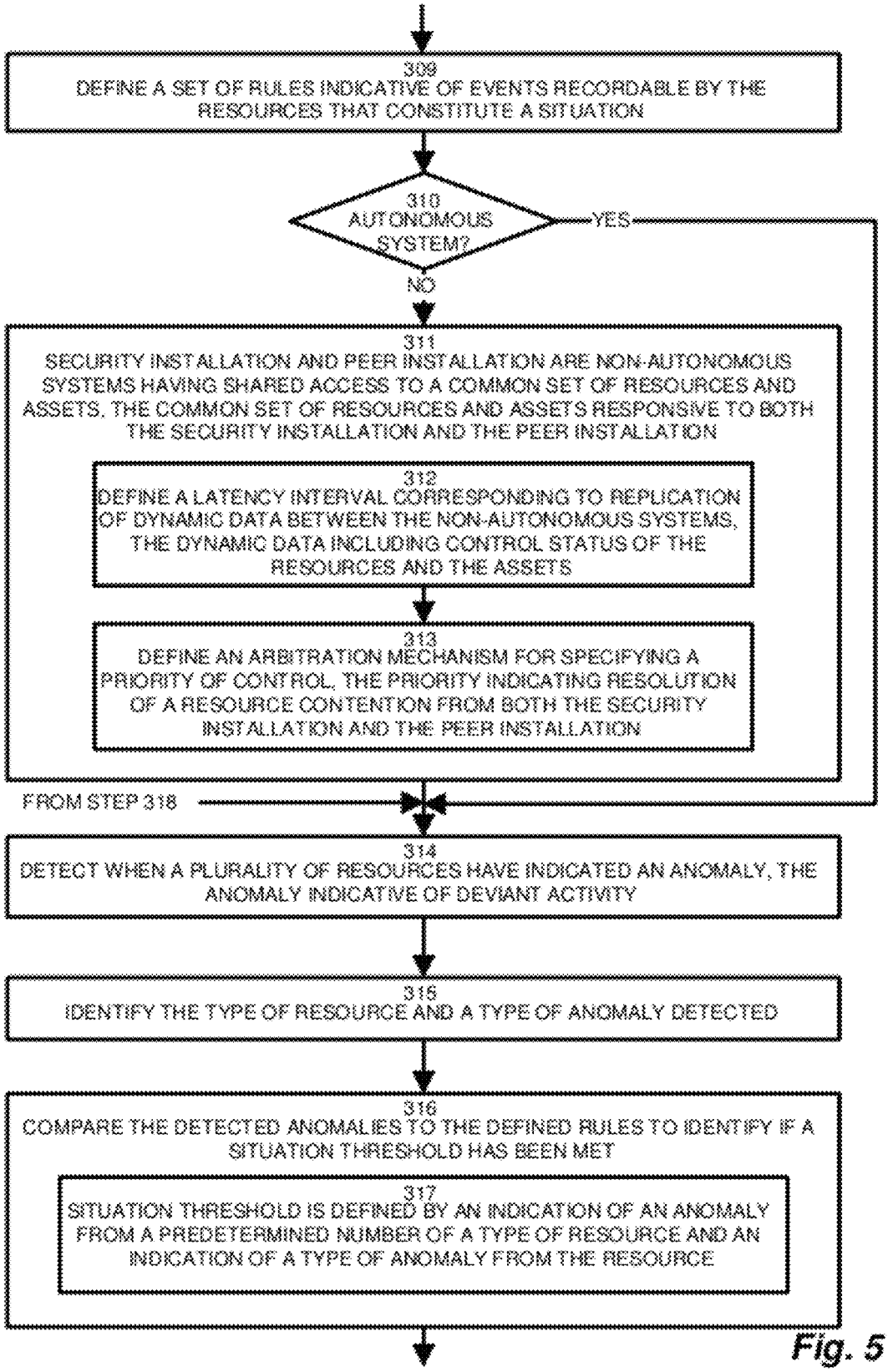
Figure 6:
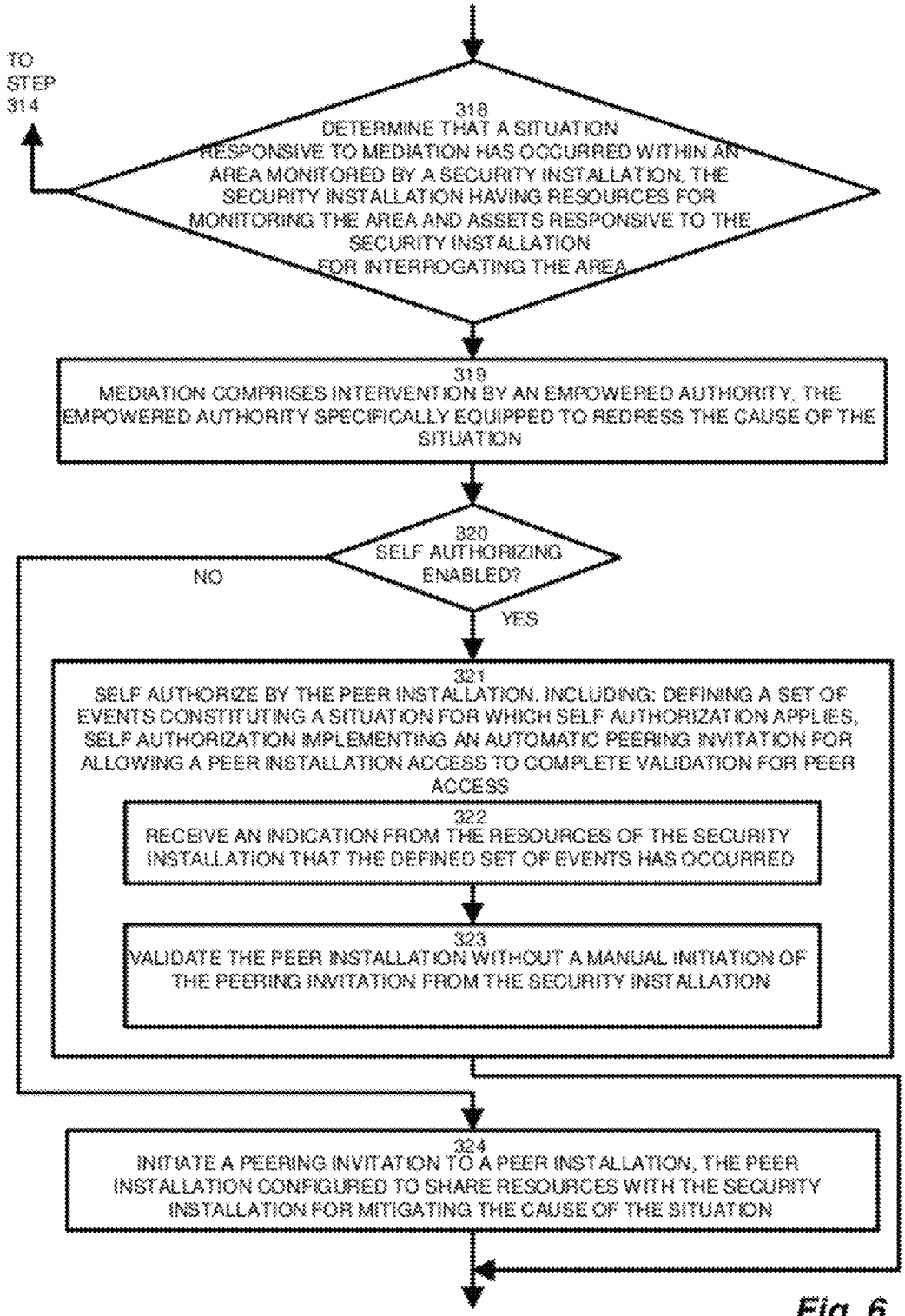
Figure 7:
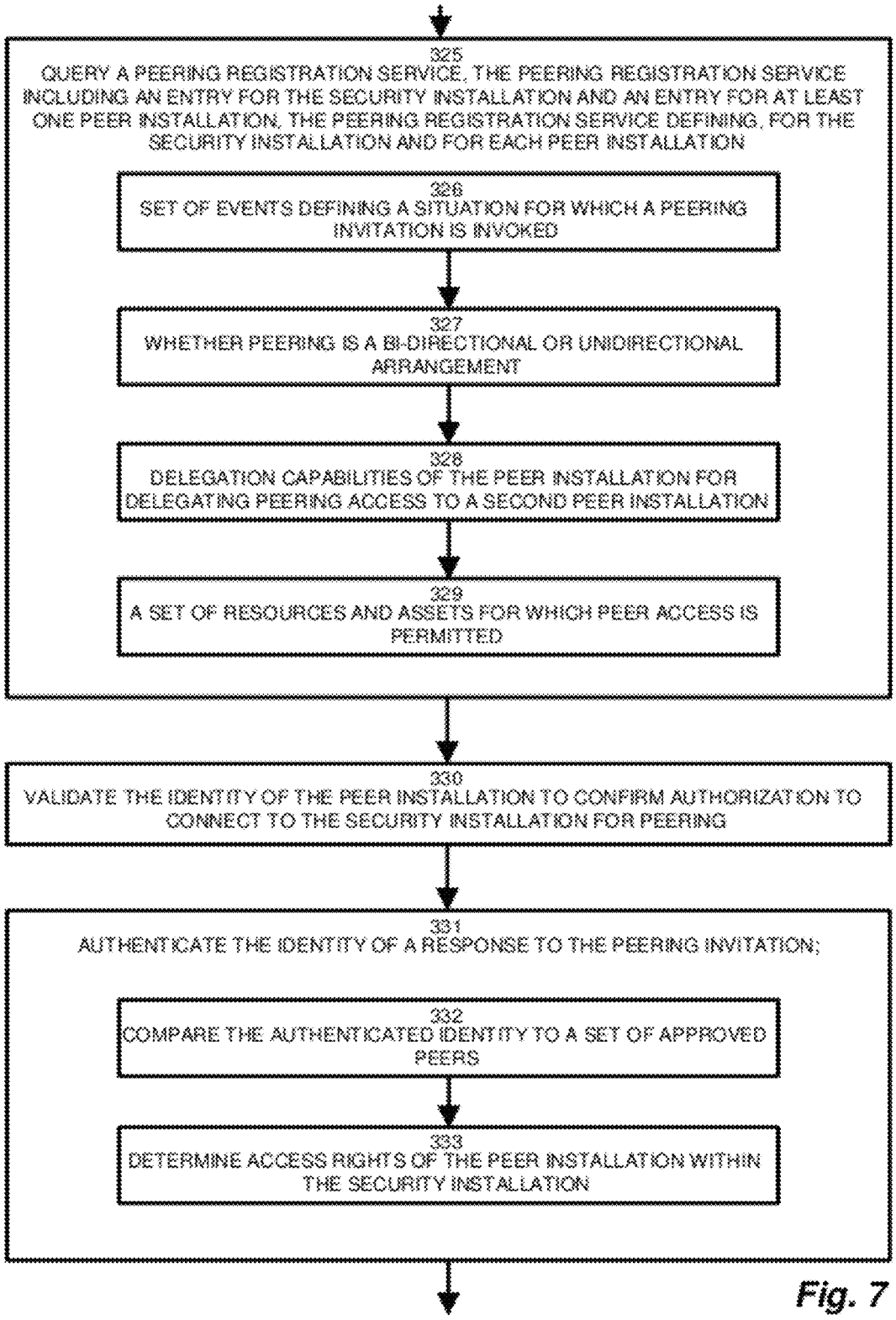
Figure 8:
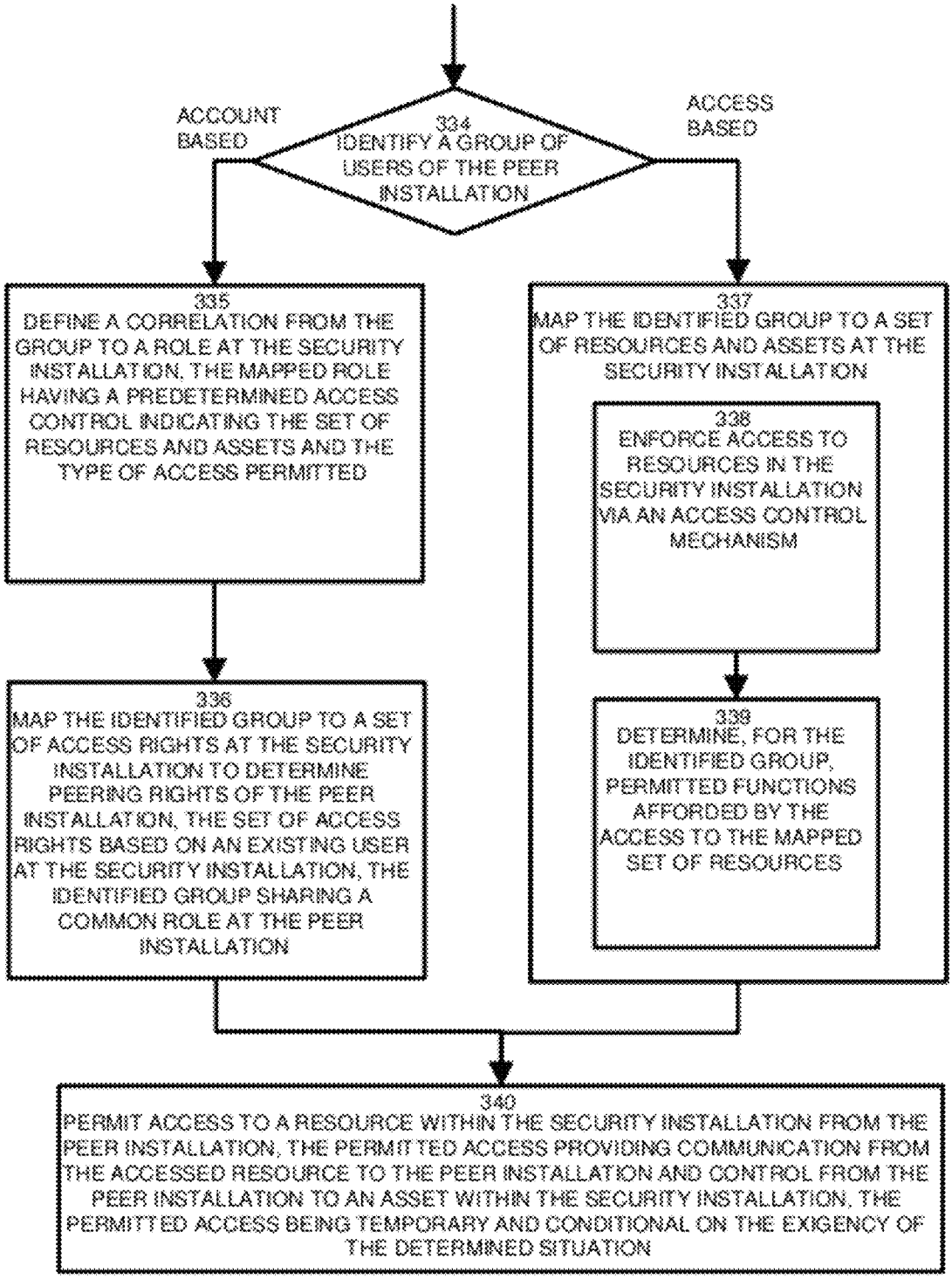

FIG. 3 is a block diagram of security monitoring system peering according to the flowchart of FIG. 2. Referring to FIGS. 1 and 3, the security installation 110 performs security monitoring over an area 100, such as a building, campus, facility, etc. The security installation 110 includes an array of physical components distributed throughout the area 110 and having a central dispatch or focal point preferable configured for human operator feedback and direction. Such a dispatch may take the form of a security office or booth, and includes a security server 112 (server), a situation analyzer 114, a central office 116 for human interaction, and a peer interface 150 for establishing a peer connection 190 to peer installations 152. The server 112 includes processors and instructions for electronic communication and control of the resources and assets, such as the PSIM system previously described, and for computing and implementing appropriate responses thereto. In the example arrangement, the server 112 includes software products commercially marketed by Vid-Sys, Inc., as disclosed above.

The situation analyzer 114 determines when a situation warranting peering occurs. The situation analyzer 114 performs a rule based analysis using input from the resources 130, and rules 118 derived from the peering agreement 180, and may include features such as those outlined in copending U.S. patent application Ser. No. 12/125,115, filed May 22, 2008, entitled "EVENT CAPTURE, CROSS DEVICE EVENT CORRELATION, AND RESPONSIVE ACTIONS," incorporated herein by reference. Based on the peering agreement, the rules 118 specify the types and number of events that trigger a situation, and the peer installation 152 that a peering invitation 170 would apply to. For example, a high temperature indication coupled with a smoke detection would trigger a rule that a peering invitation 170 is made to the peer installation 152-3 of the fire department. Similarly, a sharp sound such as a gunshot or glass breaking, coupled with an after hours motion sensor alarm would trigger a rule that the peer installation 152-2 of the police department be invoked. Rules may also require recurrence or frequency, such as a series of after hours movement (motion) in a dormant area, to accommodate the occasional rounds of a security guard or janitor, for example.

A set of resources 130, such as video cameras 132, fire sensors, motion detectors, door/window detectors and others provide input to the server 112, and a set of assets 140 receives direction for performing actions within the area 100, such as locking and unlocking doors, opening and closing gates, operating lights, and sending a peering invitation 170, discussed further below. The peering invitation may require proactive sanctioning or confirmation by a human operator, or may permit self authorization by a responding party, as in the case of a fire where it is unlikely or undesirable to expect and receive an affirmative confirmation.

The peering invitation 170 is received from the interface 150 by a peer installation 152, or implied 192 as in the case of automatic or self authorization. The interface 150 continues to support the connection 190 to the peer installation 152 for allowing access and control of resources 130 and assets 140. Further, peering rights may be delegated or hierarchically assigned to one or more delegated peers 152'. For example, a police or fire peer installation 152-2, 152-3 may delegate to the local hospital 152-1, or a particular situation may escalate according to a hierarchy of state and federal authorities, such as to state police and then to a federal entity such as the FBI or EPA, for example, depending on the nature of the situation.

FIGS. 4-8 are a flowchart of security system monitoring, detection, and peering in the system depicted in FIG. 3. Referring to FIGS. 3-8, a peering relationship and operation typically begins with a peering agreement 180 between potential peer installations 110, 152. The disclosed method defines a peering agreement 180 between the security installation 110 and the peer installation 152, as depicted at step 200. The peering agreement 180 may also encompass multiple parties, such as schools in a particular municipality as well as local police, fire, and hospitals. Such a peering agreement may be codified on paper, or may be entirely electronic, and indicates to the security installation 110 the situations for which peering is permitted, as depicted at step 301, the duration and termination of the peering agreement, as shown at step 302, the groups of users of the peer installation permitted to access the security installation 110 via the peer connection 190, as depicted at step 303, the resources 130 at the security installation 110 responsive to the peer installation 152, as disclosed at step 304, and the assets 140 at the security installation 110 controllable by the peer installation 152, as disclosed at step 305. Other parameters may be included, and the conditions to establish peering may be automatic, as is preferable with emergency "first responder" types of situations, or may require proactive consent by the security installation.

Once a peering agreement 180 is in place, normal operation typically entails the security installation 110, prior to determining any occurrence of a peering situation, monitoring the area for security purposes, as shown at step 306. The normal "business as usual" operation includes interrogating the resources 130 for receiving input relating to the area 100, as depicted at step 307, and directing the assets 308 for partitioning and restricting the monitored area. Typical resources 130 include devices such as video cameras 132, frequently observed by security personnel, and may include automated features such as object and/or face recognition and other image processing aspects. Assets 140 include items such as door locks and gates, which may be locked and unlocked at particular times or set for keycard/passcode only operation at particular times.

In order to identify a situation from among the normal day-to-day operations at the security installation 110, the situation analyzer defines a set of rules 118 indicative of events recordable by the resources 130 that constitute a situation, as depicted at step 309. A further distinction is drawn depending on whether peering is enabled with autonomous or non-autonomous systems, as shown at step 310. In an autonomous system, devices are not normally shared with other systems, hence installations normally maintain separate management and establish shared control only via peering. Non-autonomous systems are typically different branches or groups of a common larger organization or entity. In the case of a non-autonomous peering, the security installation 110 and peer installation 152 normally have shared access to a common set of resources 130 and assets 140, such that the common set of resources 130 and assets 140 is responsive to both the security installation 110 and the peer installation 152, as shown at step 311. A peering relationship between non-autonomous systems may generate conflicting and/or ambiguous control scenarios. Accordingly, the security server 112 defines a latency interval corresponding to replication of dynamic data between the non-autonomous systems, such that the dynamic data includes a control status of the resources 130 and the assets 140, as depicted at step 312. The server 112 also defines an arbitration mechanism for specifying a priority of control, in which the priority indicates resolution of a resource contention from both the security installation 110 and the peer installation 152, as disclosed at step 313.

During the normal course of operation, the security server 112 identifies and reports events which may or may not evoke a human or automated response from the central office 116 or security server 112, respectively. The security server 112 detects when one or more resources 130 have indicated an anomaly indicative of deviant activity within the area 100, as depicted at step 314, and identifies the type of resource 130 and a type of anomaly detected, as disclosed at step 315. The situation analyzer 114 compares the detected anomalies to the defined rules 118 to identify if a situation threshold has been met, as depicted at step 316. Alternatively, deviant activity may be determined or concluded simply by operator inspection of a monitor and/or area, thus involving manual triggering of a peering need, such as via a phone call or email. The situation threshold is defined by an indication of an anomaly from a predetermined number of a type of resource 130 and an indication of a type of anomaly from the resource 130, as shown at step 317, and may cover a variety of different scenarios, such as the fire alarm and break-in examples depicted above. The rules 118 are suited to the particular security installation 110 and are tailored to identify a sequence of events, including recurrence of the same event or a particular combination of complementary occurrences, that indicate a substantial enough departure from the normal course of action to conclude that a response to the situation is appropriate.

A check is performed, at step 318, to determine if a situation responsive to mediation has occurred within the area 100 monitored by the security installation 110, in which the security installation 110 has resources 130 for monitoring the area 100 and assets 140 responsive to the security installation 110 for interrogating the area. If no redressable situation has occurred, control reverts to step 314 to continue monitoring. Otherwise, the security installation 110 has concluded that mediation is called for to resolve the situation, in which mediation includes intervention by an empowered authority, such that the empowered authority (e.g. police, fire) is specifically equipped to redress the cause of the situation, as depicted at step 319.

A check is performed, at step 320, to determine if self authorization is enabled. If so, the peer installation 152 is automatically enabled by the security server 112 or other means (such as a password known to the peer installation). Self authorization is desirable if it is impracticable or unsafe for human operator availability to enable peering, such as in the case of a fire or other evacuation leaving the central office 116 devoid of human operators to provide an affirmative peering invitation 170. In the case of self authorizing, the peering invitation 170 further comprises self authorization by the peer installation 152, including: defining a set of events received at the security installation constituting a situation for which self authorization applies, self authorization implementing an automatic peering invitation for allowing a peer installation access to complete validation for peer access, as depicted at step 321. In such a scenario, the security server receives an indication from the resources 130 of the security installation 110 that the defined set of events has occurred, as depicted at step 322, and validates the peer installation 152 by automatically enabling a connection 192 without a manual initiation of the peering invitation 170 from the security installation 110, as disclosed at step 323.

Otherwise, a proactive response provides the peering invitation 170, such as an electronic port, address, or firewall command, or a transmitted password, for example. Otherwise, the security server 110 initiates a peering invitation 170 to a peer installation 152, in which the peer installation 152 is configured to share resources 130 with the security installation 110 via the peering connection 190 for mitigating the cause of the situation, as depicted at step 324.

Depending on the arrangement and availability of potential peer installations 152, the peering invitation 170 or self-authorization 192 may employ a peering registration service employing a peer registration database 194. Depending on the peer installation 152 sought by the situation, the security server 112 queries a peering registration service having the peer registration database 194. The peering registration service and database 194 includes an entry for the security installation 110 and an entry for at least one peer installation 152, such that the peering registration service defines operational parameters for the security installation 110 and for each peer installation 152, as shown at step 325. The operational parameters enable differences in data formats, protocols, and user privileges to be normalized or translated between peered installations 110, 152 by transferring metadata and protocol information. In the example arrangement disclosed, the peer registration database 194 includes information pertaining to a set of events defining a situation for which a peering invitation 170 is invoked, as shown at step 326; whether peering is a bi-directional or unidirectional arrangement, as depicted at step 327, delegation capabilities of the peer installation 152 for delegating peering access to a second peer installation 152', as disclosed at step 328; and a set of resources 130 and assets 140 for which peer access is permitted, as depicted at step 329.

Depending on the desired response to a specific situation, particularly in the case of self-authorizing peer installations 152, different peers 152 may be called upon depending on the nature of the situation. A detected break-in would have little need for the fire department. Bi-directional and unidirectional peering indicate a reciprocal relationship with respect to shared assets, since an assisting organization may have little need to make their resources available to the assisted security installation, e.g. the school doesn't need access to the police department's systems for investigating a break-in. However, the police department may appreciate the ability to delegate peering to other entities that may be called in if a situation escalates, such at to state police and federal authorities. A non-delegatable peering limits the peered installation 152 from transferring access any further. Also, peered access may be provided not absolutely, but rather only to resources 130 and assets 140 germane to the situation.

Once the peer installation 152 is identified and any registration information processed, the security installation validates the identity of the peer installation 152 to confirm authorization to connect to the security installation 110 for peering, as depicted at step 330. This may simply involve a password authentication, or may invoke more substantial authorization such as public key credentials and/or biometric authentication, as the access sensitivity demands, as shown at step 331. Accordingly, validating the identity of the peer installation 152 generally includes authenticating the identity of a response to the peering invitation, and comparing the authenticated identity to a set of approved peers 152, as disclosed at step 332. The security server 112 then determines the access rights of the peer installation 152 within the security installation 110. As indicated above, absolute access to all resources 130 and assets 140 need not be provided, depicted at step 333.

Once the particular peer installation 152 has been determined and authentication has been confirmed, the access control applicable to the peer installation 152 is determined. In a small installation, complete access to all of the resources 130 and assets 140 by the peer installation may be appropriate, however it is likely that only necessary or prudent access and control be given the peer installation 152, and then only to individual operators with adequate knowledge of the security installation to be effective. One mechanism employed in the example arrangement is group based, and denotes a group of users having similar access rights from the peer installation to have similar rights (access) to the security installation. Accordingly, determining the access rights includes identifying a group of users of the peer installation, as shown at step 334.

A group of users may be associated with individual access rights, or mapped to the same rights as a particular native user (i.e. guest) of the security installation. If a particular user (i.e. account) at the security installation is employed, then mapping defines a correlation from the group to a role (i.e. account) at the security installation 110, such that the mapped role has predetermined access control indicating the set of resources 130 and assets 140 and the type of access permitted at the security installation, as shown at step 335. The security installation then maps the identified group to a set of access rights at the security installation 110 to determine peering rights of the peer installation 152, such that the set of access rights is based on an existing user at the security installation 110, as depicted at step 336. In this manner, the identified group shares a common role at the peer installation;

If a higher level of granularity is appropriate, then the security server 112 maps the identified group from the peer installation to a set of resources 130 and assets 140 at the security installation 110, as depicted at step 337, thus enforcing access to resources in the security installation via an access control mechanism specific to individual resources 130 and assets 140, as shown at step 338, rather than tying the entire group to a single account at the security installation, which might leave a subset of peered users with excessive or inadequate access. The peer installation 110 thus identifies a group corresponding to a set of access rights at the peer installation, for which the security server then determines, for the identified group, permitted functions afforded by the access to the mapped set of resources 130 and assets 140, as depicted at step 339. At step 340, the security server 112 permits access to a resource 130 within the security installation 110 from the peer installation 152, in which the permitted access provides communication from the accessed resource 130 to the peer installation 152 and control from the peer installation 152 to an asset 140 within the security installation, the permitted access being temporary and conditional on the exigency of the determined situation. Thus, the peered system employs the resources 130 and assets 140 as its own for the duration of the situation, and peered access withdrawn once the exigency subsides. Less critical situations, such as the non-autonomous (i.e. same organization) scenario suggested above, may employ peered access as an alternative control mechanism, possible in a failover mode if the central office 116 of a particular facility is disabled or compromised.

Those skilled in the art should readily appreciate that the programs and methods for video security system peering defined herein are deliverable to a user processing and rendering device in many forms, including but not limited to a) information permanently stored on non-writeable storage media such as ROM devices, b) information alterably stored on writeable storage media such as floppy disks, magnetic tapes, CDs, RAM devices, and other magnetic and optical media, or c) information conveyed to a computer through communication media, as in an electronic network such as the Internet or telephone modem lines. The operations and methods may be implemented in a software executable object or as a set of encoded instructions for execution by a processor responsive to the instructions. Alternatively, the operations and methods disclosed herein may be embodied in whole or in part using hardware components, such as Application Specific Integrated Circuits (ASICs), Field Programmable Gate Arrays (FPGAs), state machines, controllers or other hardware components or devices, or a combination of hardware, software, and firmware components.

While the system and method for video security system peering has been particularly shown and described with references to embodiments thereof, it will be understood by those skilled in the art that various changes in form and details may be made therein without departing from the scope of the invention encompassed by the appended claims.

What is claimed is:

1. A method of selectively coupling security installations for area monitoring comprising:

determining that a situation responsive to mediation has occurred within an area monitored by a security installation, the security installation having resources for monitoring the area and assets responsive to the security installation for interrogating the area;

initiating a peering invitation to a peer installation, the peer installation being an autonomous installation configured to share resources with the security installation for mitigating a cause of the situation, initiating the peering invitation further comprising self authorization by the peer installation, including receiving an indication from the resources of the security installation that the defined set of events has occurred;

validating an identity of the peer installation to confirm authorization to connect to the security installation for peering; and permitting access to a resource within the security installation from the peer installation, the permitted access providing communication from the accessed resource to the peer installation and control from the peer installation to an asset within the security installation, the permitted access being temporary and conditional on the exigency of the determined situation.

2. The method of claim 1 further comprising, prior to determining the situation, monitoring the area for security purposes by:

interrogating the resources for receiving input relating to the area; and directing the assets for partitioning and restricting the monitored area.

3. The method of claim 2 wherein mediation comprises intervention by an empowered authority, the empowered authority specifically equipped to redress the cause of the situation.

4. The method of claim 2 further comprising defining a peering agreement between the security installation and the peer installation, the peering agreement defining:

situations for which peering is permitted;

duration and termination of the peering agreement;

groups of users of the peer installation permitted to access the security installation via a peer connection;

resources at the security installation responsive to the peer installation; and assets at the security installation controllable by the peer installation.

5. The method of claim 2 wherein self authorization by the peer installation includes:

defining the set of events constituting a situation for which self authorization applies, self authorization implementing an automatic peering invitation for allowing a peer installation access to complete validation for peer access; and validating the peer installation without a manual initiation of the peering invitation from the security installation.

6. The method of claim 5 further comprising querying a peering registration service, the peering registration service including an entry for the security installation and an entry for at least one peer installation, the peering registration service defining, for the security installation and for each peer installation:

a set of events defining a situation for which a peering invitation is invoked;

whether peering is a bi-directional or unidirectional arrangement;

delegation capabilities of the peer installation for delegating peering access to a second peer installation; and a set of resources and assets for which peer access is permitted.

7. The method of claim 1 wherein determining whether the situation has occurred further comprises:

defining a set of rules indicative of events recordable by the resources that constitute a situation;

detecting when a plurality of resources have indicated an anomaly, the anomaly indicative of deviant activity;

identifying the type of resource and a type of anomaly detected; and comparing the detected anomalies to the defined rules to identify if a situation threshold has been met.

8. The method of claim 7 wherein the situation threshold is defined by an indication of an anomaly from a predetermined number of a type of resource and an indication of a type of anomaly from the resource.

9. The method of claim 1 wherein validating the identity of the peer installation further authenticating the identity of a response to the peering invitation;

comparing the authenticated identity to a set of approved peers; and determining access rights of the peer installation within the security installation.

10. The method of claim 9 wherein determining the access rights further comprises identifying a group of users of the peer installation; and mapping the identified group to a set of access rights at the security installation to determine peering rights of the peer installation, the set of access rights based on an existing user at the security installation.

11. The method of claim 9 further comprising enforcing access to resources in the security installation via an access control mechanism, further including:

identifying a group corresponding to a set of access rights at the peer installation, the identified group sharing a common role at the peer installation;

mapping the identified group to a set of resources and assets at the security installation; and determining, for the identified group, permitted functions afforded by the access to the mapped set of resources.

12. The method of claim 11 wherein mapping defines a correlation from the group to a role at the security installation, the mapped role having a predetermined access control indicating the set of resources and assets and the type of access permitted.

13. The method of claim 1 wherein the security installation and peer installation are non-autonomous systems having shared access to a common set of resources and assets, the common set of resources and assets responsive to both the security installation and the peer installation, further comprising:

defining a latency interval corresponding to replication of dynamic data between the non-autonomous systems, the dynamic data including control status of the resources and the assets; and defining an arbitration mechanism for specifying a priority of control, the priority indicating resolution of a resource contention from both the security installation and the peer installation.

14. The method of claim 1 wherein permitting the peered access further comprises:

identifying the resources and assets which will be shared; and identifying the duration of the peering based on resolution of the exigent situation that prompted the peering.

15. The method of claim 1 further comprising predisposing a peering ability with a peer installation by establishing a peering agreement to define the conditions constituting a situation for which peering applies.

16. The method of claim 1 further comprising defining the peering relationship wherein that the peer institution identifies the shared resources via the peering relationship, such that peered resources are not preconfigured as assets on the peering institution.

17. The method of claim 16 wherein the resources and assets made available via the peering relationship are unavailable from the peering system without an active peering relationship.

18. A security installation having a peer interface for selective connection to a peer installation comprising:

a situation analyzer configured for determining that a situation responsive to mediation, mediation including intervention by an empowered authority equipped to redress a cause of the situation, has occurred within an area monitored by a security installation, the security installation having resources for monitoring the area and assets responsive to the security installation for interrogating the area;

a peering interface configured for initiating a peering invitation to a peer installation, the peer installation configured to share resources with the security installation for mitigating the cause of the situation, the peering interface responsive to self authorization by the peer installation, including receiving an indication from the resources of the security installation that a predefined set of events has occurred;

a security server configured for validating an identity of the peer installation to confirm authorization to connect to the security installation for peering, the peering interface responsive to the security server for:

permitting access to a resource within the security installation from the peer installation, the permitted access providing communication from the accessed resource to the peer installation and control from the peer installation to an asset within the security installation, the permitted access being temporary and conditional on the exigency of the determined situation; and a set of resources and assets responsive to the security server for, prior to determining the situation, monitoring the area for security purposes by:

interrogating the resources for receiving input relating to the area; and directing the assets for partitioning and restricting the monitored area.

19. The security installation of claim 18 further comprising a defined peering agreement between the security installation and the peer installation, the peering agreement defining:

situations for which peering is permitted;

duration and termination of the peering agreement;

groups of users of the peer installation permitted to access the security installation via a peer connection;

resources at the security installation responsive to the peer installation; and assets at the security installation controllable by the peer installation.

20. The security installation of claim 18 wherein self authorization by the peer installation includes:

defining the set of events constituting a situation for which self authorization applies, self authorization implementing an automatic peering invitation for allowing a peer installation access to complete validation for peer access; and validating the peer installation without a manual initiation of the peering invitation from the security installation.

21. The security installation of claim 18 further comprising a set of rules in the situation analyzer configured for determining whether the situation has occurred, further comprising:

defining a set of rules indicative of events recordable by the resources that constitute a situation;

detecting when a plurality of resources have indicated an anomaly, the anomaly indicative of deviant activity;

identifying the type of resource and a type of anomaly detected; and comparing the detected anomalies to the defined rules to identify if a situation threshold has been met, the situation threshold defined by an indication of an anomaly from a predetermined number of a type of resource and an indication of a type of anomaly from the resource.

22. The security installation of claim 18 wherein the security installation and peer installation are non-autonomous systems having shared access to a common set of resources and assets, the common set of resources and assets responsive to both the security installation and the peer installation, further comprising:

defining a latency interval corresponding to replication of dynamic data between the non-autonomous systems, the dynamic data including control status of the resources and the assets; and defining an arbitration mechanism for specifying a priority of control, the priority indicating resolution of a resource contention from both the security installation and the peer installation.

23. The security installation of claim 18 further comprising peering registration database configured for providing a peering registration service, the peering registration service including an entry for the security installation and an entry for at least one peer installation, the peering registration service defining, for the security installation and for each peer installation:

a set of events defining a situation for which a peering invitation is invoked;

whether peering is a bi-directional or unidirectional arrangement;

delegation capabilities of the peer installation for delegating peering access to a second peer installation;

metadata for transferring data between the security installation and the peer installation; and a set of resources and assets for which peer access is permitted.

24. A computer program on a computer readable storage medium encoded as a set of processor based instructions that, upon execution by a processor, cause the computer to perform a method for peering a multi node security installation, the method comprising:

determining that a situation responsive to mediation has occurred within an area monitored by a security installation, the security installation having resources for monitoring the area and assets responsive to the security installation for interrogating the area;

initiating a peering invitation to a peer installation, the peer installation configured to share resources with the security installation for mitigating a cause of the situation, initiating the peering invitation further comprising self authorization by the peer installation, including:

defining a set of events constituting a situation for which self authorization applies, self authorization implementing an automatic peering invitation for allowing a peer installation access to complete validation for peer access; and receiving an indication from the resources of the security installation that the defined set of events has occurred;

validating an identity of the peer installation without a manual initiation of the peering invitation from the security installation to confirm authorization to connect to the security installation for peering; and permitting access to a resource within the security installation from the peer installation, the permitted access providing communication from the accessed resource to the peer installation and control from the peer installation to an asset within the security installation, the permitted access being temporary and conditional on the exigency of the determined situation.

* * * * *